United States Patent [19]

Fournier et al.

[11] Patent Number: 5,040,475

[45] Date of Patent: Aug. 20, 1991

[54] MATERIAL HANDLING SYSTEM

[75] Inventors: Claude Fournier; Patrick Hauguet; Robert Burguiere; Jean-Pierre Peauger, all of Autun, France

[73] Assignee: Sara Lee Corporation, Winston-Salem, N.C.

[21] Appl. No.: 649,129

[22] Filed: Jan. 29, 1991

Related U.S. Application Data

[63] Continuation of Ser. No. 317,200, Jan. 28, 1989, abandoned.

[51] Int. Cl.[5] ..... D05B 21/00; A41H 43/00

[52] U.S. Cl. ..... 112/121.15; 112/262.2; 223/43

[56] References Cited

U.S. PATENT DOCUMENTS

| | | | |
|---|---|---|---|
| Re. 30,410 | 10/1980 | Povlacs | 406/87 |
| 3,163,470 | 12/1964 | Brewin et al. | 223/43 X |
| 3,396,879 | 8/1968 | Hall | 223/43 |
| 3,941,069 | 3/1976 | Fukuyama | 112/262 |
| 4,099,789 | 7/1978 | Zaglio | 223/43 X |
| 4,364,320 | 12/1982 | Nakhle et al. | 112/262.2 |
| 4,383,490 | 5/1983 | Hodges | 112/121.15 |
| 4,538,534 | 9/1985 | Frazier et al. | 112/262.2 |
| 4,539,924 | 9/1985 | Bell, Jr. et al. | 112/262.2 |
| 4,550,868 | 11/1985 | Hodges et al. | 223/43 |
| 4,598,817 | 7/1986 | Bell, Jr. et al. | 198/468.2 |
| 4,602,710 | 7/1986 | Bell, Jr. et al. | 112/121.15 X |
| 4,643,340 | 2/1987 | Bailey | 223/40 |
| 4,649,838 | 3/1987 | Gazzarrini | 112/121.15 |

FOREIGN PATENT DOCUMENTS

| | | | |
|---|---|---|---|
| 2238533 | 3/1973 | Fed. Rep. of Germany | 223/43 |

*Primary Examiner*—Werner H. Schroeder
*Assistant Examiner*—Paul C. Lewis
*Attorney, Agent, or Firm*—Charles Y. Lackey; William S. Burden

[57] ABSTRACT

A system for handling flexible articles such as tubular hosiery blanks each having a toe portion and a welt or band portion and for subsequently closing the toe portions includes an assembly for retrieving randomly oriented blanks from a supply reservoir, a pneumatic feed assembly for displacing the blanks to a magazine, a mechanism for selectively displacing the blanks from the magazine such that the toe portion is always first, an assembly for opening the band portion and positioning the band portion on fingers which expand and convey the blank to a transport tube of a toe closing assembly. The blank is inverted on the transport tube and the toe portion subsequently sewn.

26 Claims, 9 Drawing Sheets

MATERIAL HANDLING SYSTEM

This is a continuation of co-pending application Ser. No. 07/317,200, filed on Jan. 28, 1989, now abandoned.

BACKGROUND, BRIEF SUMMARY AND OBJECTS OF THE INVENTION

This invention relates generally to a flaccid article handling system, and more particularly the invention concerns the processing of fabric pieces.

Flaccid hosiery articles such as circular knit hosiery blanks are difficult to handle mechanically, particularly in a manner that will orient the blanks for subsequent operations, such as closing end portions of the blanks.

In the manufacture of hosiery, it has been customary for an operator to manually retrieve a knit blank from a supply reservoir and hold the toe portion in front of a suction tube of a toe closing machine. The operator then events the blank by pulling the blank over the suction tube. The blank is subsequently conveyed to sewing instrumentalities for closing of the toe portion of the blank.

The present invention provides for automatically randomly retrieving a hosiery blank from a reservoir and pneumatically conveying the blank to a magazine. The blank always exits the magazine toe end first in a selected direction irregardless of whether the blank enters the magazine toe end first or band end first. The band is opened pnueumatically and then conveyed mechanically to a mechanism which dons the blank on a carrier of a toe closing machine. The handling system could equally well be extended to other types of machines for handling flexible materials, e.g. assembling or packing machines.

One of the important objects of the invention is the provision of a new and improved toe closing system which increases production, reduces expense and eliminates substantially all manual operations.

Another object of the invention is the provision of an automatic donning assembly for positioning a hosiery blank onto an elongated tubular hosiery carrier of a toe closing machine.

It is a further object of the invention to provide a novel system including pneumatic conveyor means for receiving randomly oriented hosiery blanks and which automatically operates to provide a predetermined orientation of the blanks prior to passing to the toe closure machine.

Another object of the invention is the provision of a means for sensing or determining the difference of volume between the toe end and the band end of a hosiery blank.

Further features and advantages of the invention will become apparent when considered in view of the following detailed description.

IN THE DRAWING

DETAILED DESCRIPTION OF THE INVENTION

Figure 1:
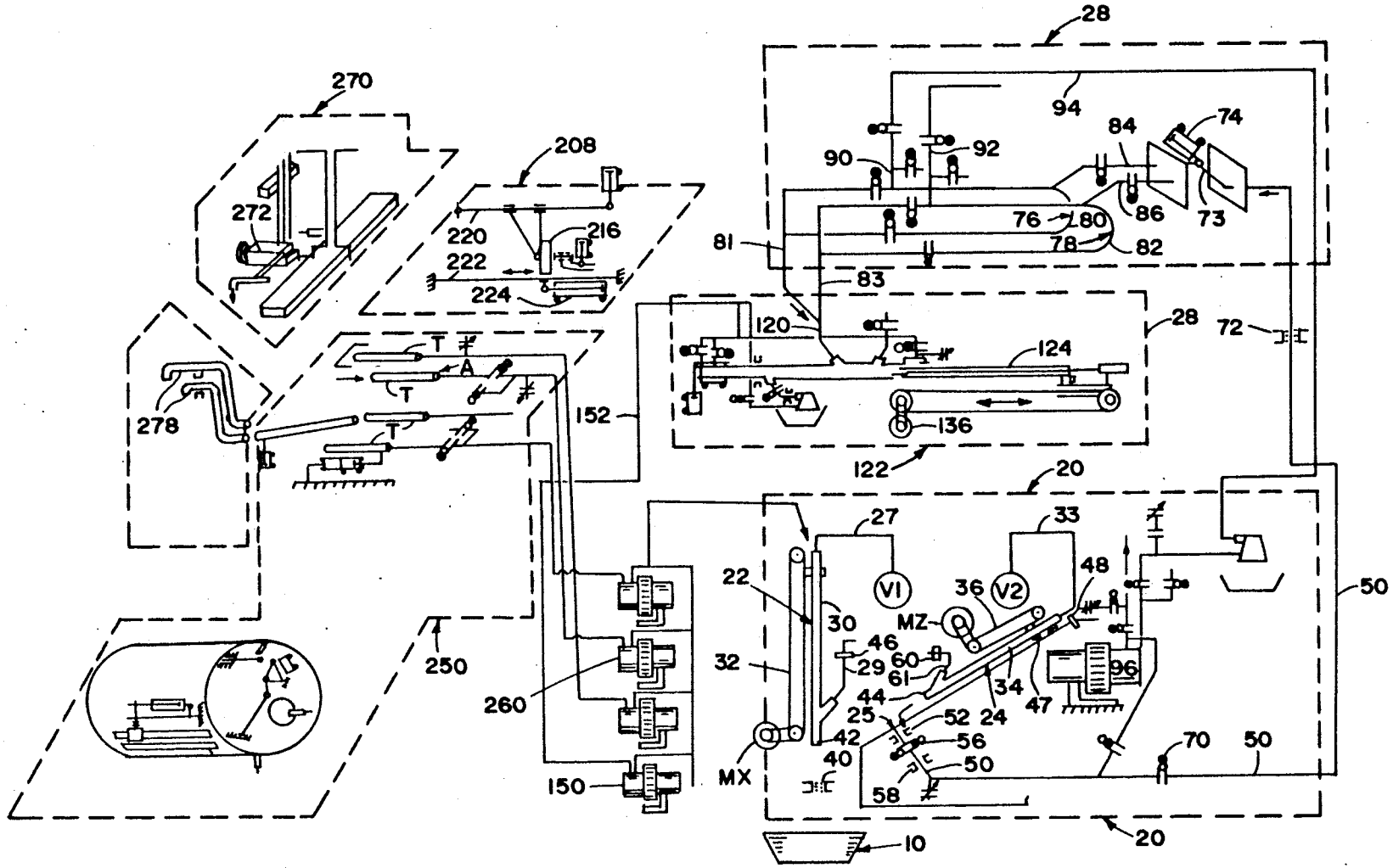
FIG. 1 is a schematic, fragmentary, perspective view of one embodiment of the apparatus, including a hosiery blank pick-up and orientation assembly, a conveyor assembly, a magazine assembly, opening assemblies, and a toe closing assembly.
Figure 2:
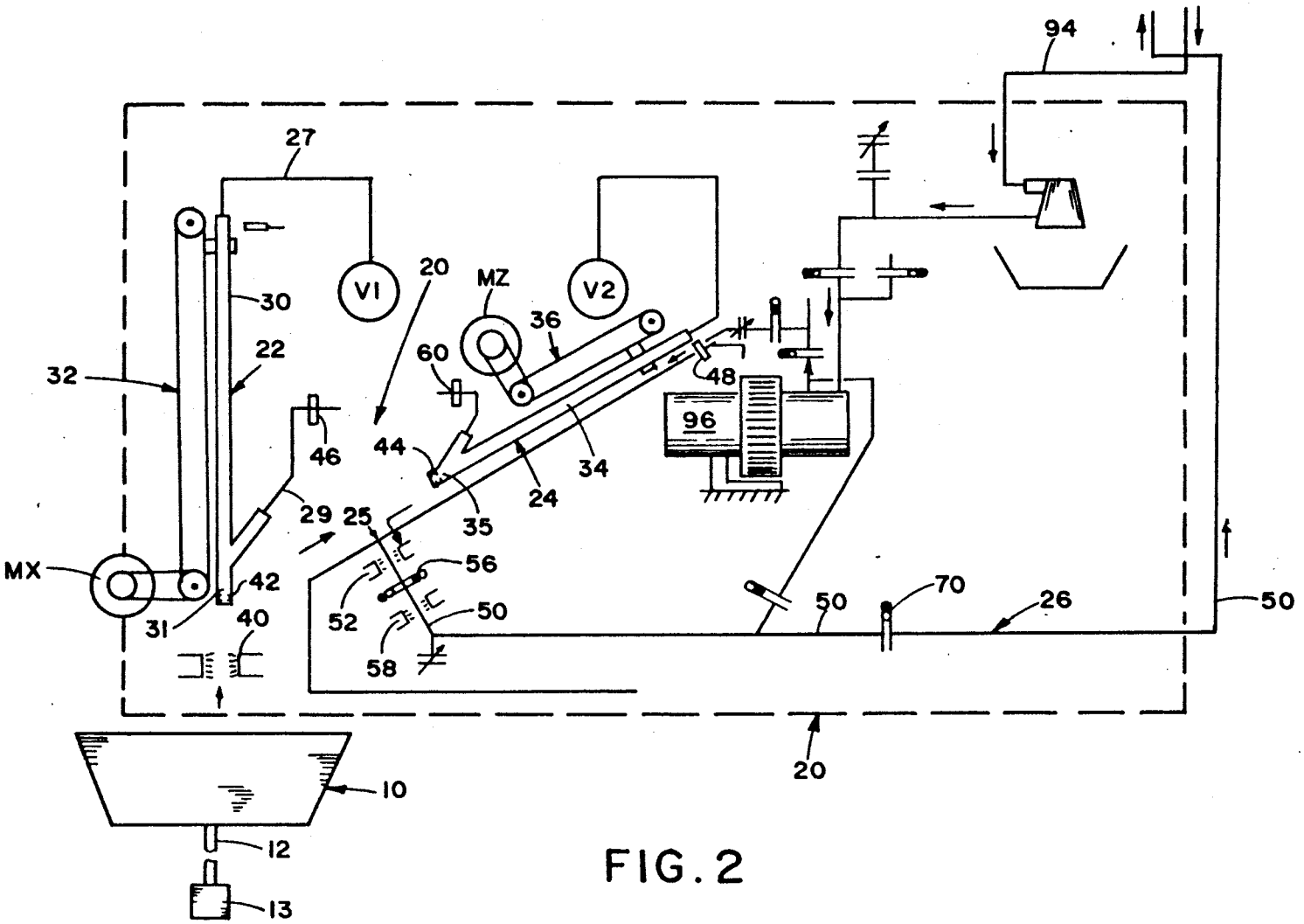
FIG. 2 is an enlarged, schematic elevational view of the blank pick-up and orientation assembly.
Figure 9:
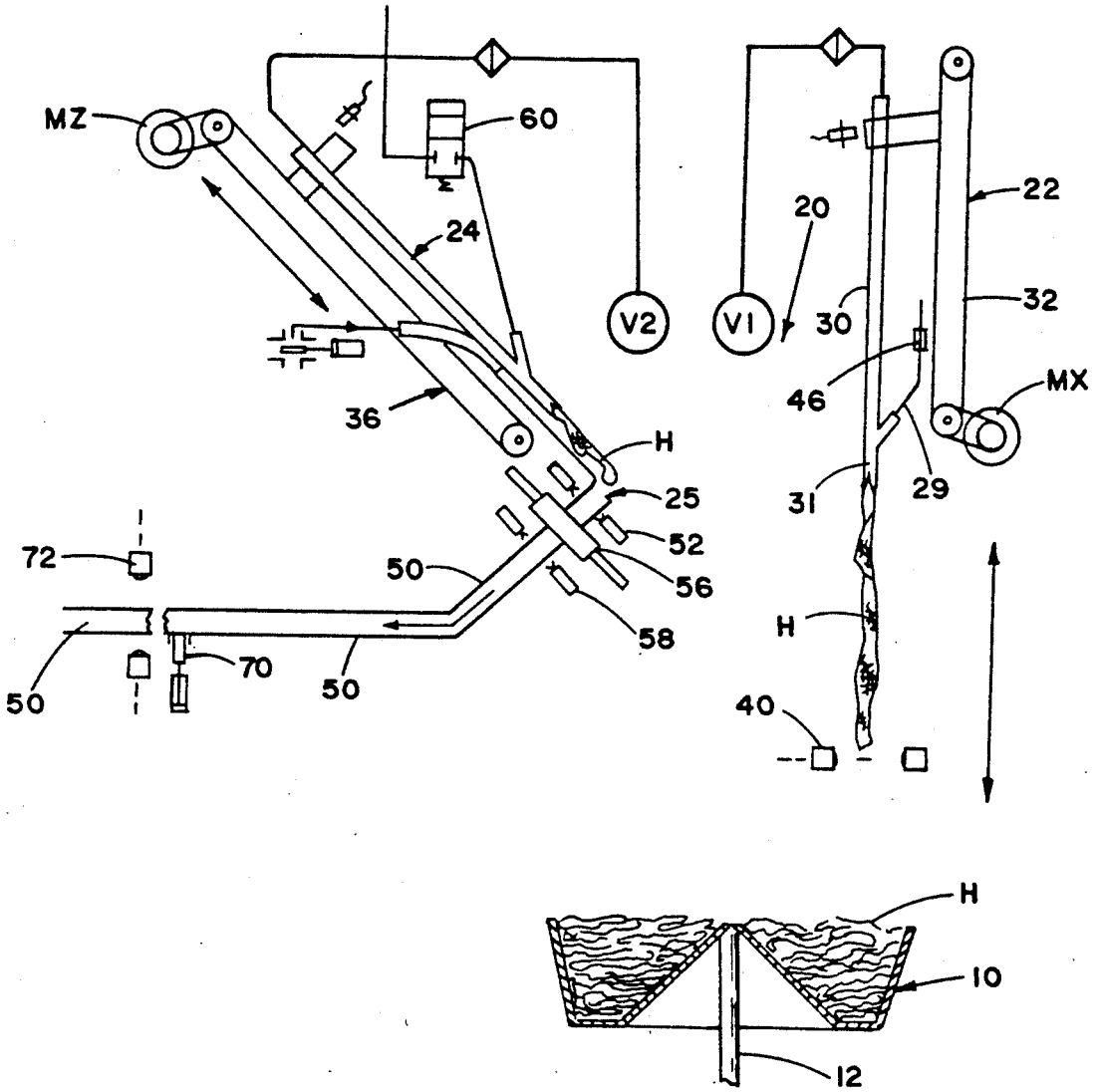
FIG. 9 is a schematic, side elevational view of the hosiery blank pick-up and orientation assembly.

Referring to the drawing, and initially to FIGS. 1, 2 and 9, thin flexible articles such as hosiery blanks H are loosely and randomly supplied to a reservoir 10. The circular reservoir is mounted upon a shaft 12 and continuously driven by a motor 13 for rotation about a vertical axis. Each knit blank has a welt or band end B and a toe end portion E.

A pick-up transfer and orientation assembly 20 includes two pick-up and transfer mechanisms 22 and 24 which function to individually pick-up randomly oriented hosiery blanks from the rotating reservoir 10 and position them at the inlet end 25 of a pneumatic conveyor assembly 26. The conveyor assembly operates to deliver the hosiery articles to a magazine assembly 28, FIGS. 1 and 3.

The pick-up transfer mechanism 22 includes a tube 30 mounted for vertical reciprocable displacement through a conventional drive arrangement 32 by electric motor MX. Pick-up transfer mechanism 24 has a similar tube 34 positioned at an angle with respect to tube 30 and mounted for reciprocable displacement by motor MZ and drive arrangement 36.

Figure 12:
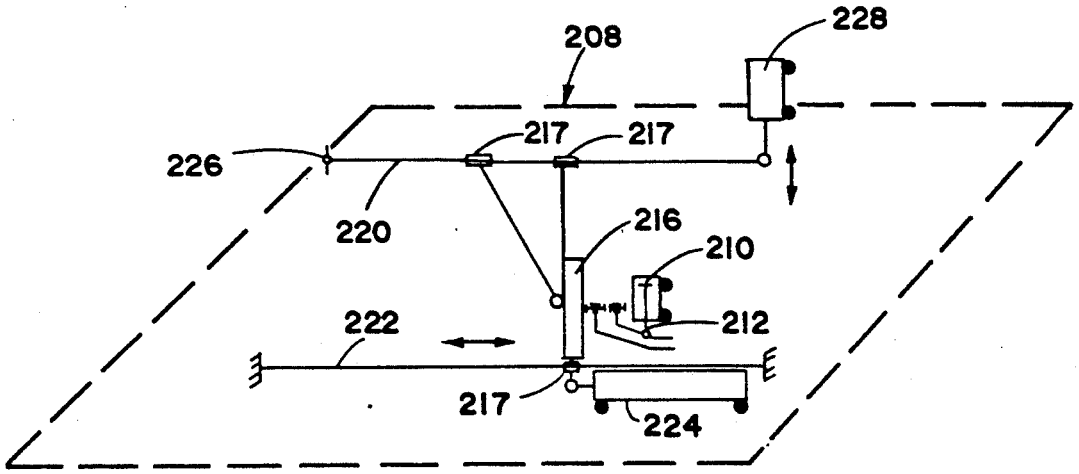
FIG. 12 is a schematic side elevational view of the loading fingers and linkage and the mechanism for conveying a hosiery blank from the opening assembly to a transport tube of a toe closing machine.

Operation of motor MX is controlled by a micropressor MP, FIG. 12. Upon receiving a signal from the microprocessor, motor MX displaces the pick-up tube 30 downwardly until the tube is sensed by photocell 40 which deactivates the motor MX with the lower end portion 31 of tube 30 within the reservoir 10.

It is to be noted that each of tubes 30 and 34 have coupled thereto a vacuum conduit, a compressed air conduit, and an electrical line connected to a photocell. The lower end portion 31, 35 of each tube 30, 34 is provided with a narrow slit or opening, partially shown in FIG. 9. Vacuum is created in conduit 27 and tube 30 by vacuum motor V1, and in conduit 33 and tube 34 by vacuum motor V2.

When a hosiery blank H in the reservoir 10 is pulled by vacuum in tube 30 and is pulled partially through the narrow slit, photocell 42, mounted adjacent the end of the tube detects the presence of a portion of the blank fabric extending into the slit and is activated thus sending a signal to the microprocessor MP which again activates the motor MX to move the tube 30 vertically upwardly carrying with it a hosiery blank H. As the end of the blank H passes the photocell 40, and the blank is no longer detected, the motor MX is deactivated through a signal from photocell 40 to the micropressor MP and to the motor MX. The microprocessor, upon receiving the signal from photocell 40 sends a signal which activates motor MZ to move the lower end portion 35 of tube 34 downwardly. The vacuum motor V2 creates a vacuum through conduit 33 and tube 34. The lower ends of tubes 30, 34 are positioned adjacent to each other.

The originality of the pick-up system is such that by utilizing two tubes 30 and 34, a blank is always held adjacent one end which is the main condition for the following operation of the orientation system. This system increases the probability of having just one blank on tube 34.

A portion of the hosiery blank remote to that held by the vacuum tube 30 is pulled by vacuum in tube 34 partially through the slit in the lower end of the tube thus activating photocell 44 sending a signal to the micropressor which, in turn, reverses motor MZ, and tube 34 begins to move upwardly. The photocell 44 is mounted adjacent the lower end portion of tube 34. Substantially simultaneously with the reversal of motor MZ the micropressor sends a signal to solenoid valve 46 energizing the same thus permitting a blast of compressed air to be discharged through a conduit 29 and tube 30 thus blowing the blank H away from the tube 30. A proximity switch 48 senses a bracket 47 on tube 34 when the tube moves upwardly a prescribed distance, which is sufficient to permit the free end of a blank held thereby to go into inlet end 25, and sends a signal the motor MZ to reverse the direction to start movement of the tube 34 back downwardly. As the tube descends, the portion of the blank remote to that being held by the tube 34 is drawn by vacuum into conduit 50 and past photocell 52.

Positioned in the conduit 50 below the photocell 52 is a trap 56 for sensing whether the toe portion E or the band portion B of a hosiery blank enters the trap first. The concentration or volume of yarn in the band end is greater than the volume of yarn in the toe end. The trap 56 is a two part trap having an opening large enough to receive the toe end of the blank there through, but not large enough to receive the greater volume of yarn in the band of the blank there through, The toe end, of a blank held by vacuum in tube 34, moves past photocell 52, through trap 56 and past photocell 58. When photocell 58 detects a blank H two things happen. A signal is sent to the micropressor which actives solenoid valve 60 to permit compressed air to move through conduit 61 and tube 34 to blow the blank away from the pick-up tube 34, and two part trap 56 opens permitting the blank to flow therethrough. Vacuum is created in conduit 50 by the vacuum motor 96 as will be later described.

The band portion of a blank held by vacuum in tube 34 moves past photocell 52 but cannot go through the trap 56. Tube 34 continues to move downwardly to a prescribed distance greater than the distance between photocell 52 and photocell 58. At the end of this movement, if photocell 58 is not activated, two things happen. A signal is sent to the microprocessor which activates solenoid valve 60 to permit compressed air to move through conduit 61 and tube 34 to blow the blank away from the pick-up tube 34, and two part trap 56 opens permitting the blank to flow there through. Vacuum is created in conduit 50 by the vacuum motor 96 as will be later described.

After passing the photocells 52, 58 and trap 56, the blank flows in conduit 50 through trap 70 and detector 72 and into the magazine 28.

The magazine 28 includes a conduit section 73 displaceable by a magazine switch 74 between each of assemblies 76 and 78. The conduit 73 is pivotably attached to the conduit 50. Each of the parallel conduit assemblies 76 and 78 includes a looped portions 80, 82, linear sections 84, 86, coupling the looped portions with the displaceable switch conduit 73, and exit portions 81, 83 which exits the looped portions. The switch 74 permits hosiery blanks sequentially advanced through the conduit 50 to be selectively, alternately directed from one conduit section 84 or 86 to the other. Conduit assemblies in addition to 76 and 78 could be provided if required.

The magazine assembly 28 also includes a conduit 90 communicating with conduit loop portion 80 and a conduit 92 communicating with loop portion 82. Conduits 90 and 92 merge into conduit 94 which, in turn, is connected to vacuum motor 96. Traps 100 and 102 are provided in conduit 90 and traps 104 and 106 are provided in conduit 92 (See FIG. 3).

Figure 3:
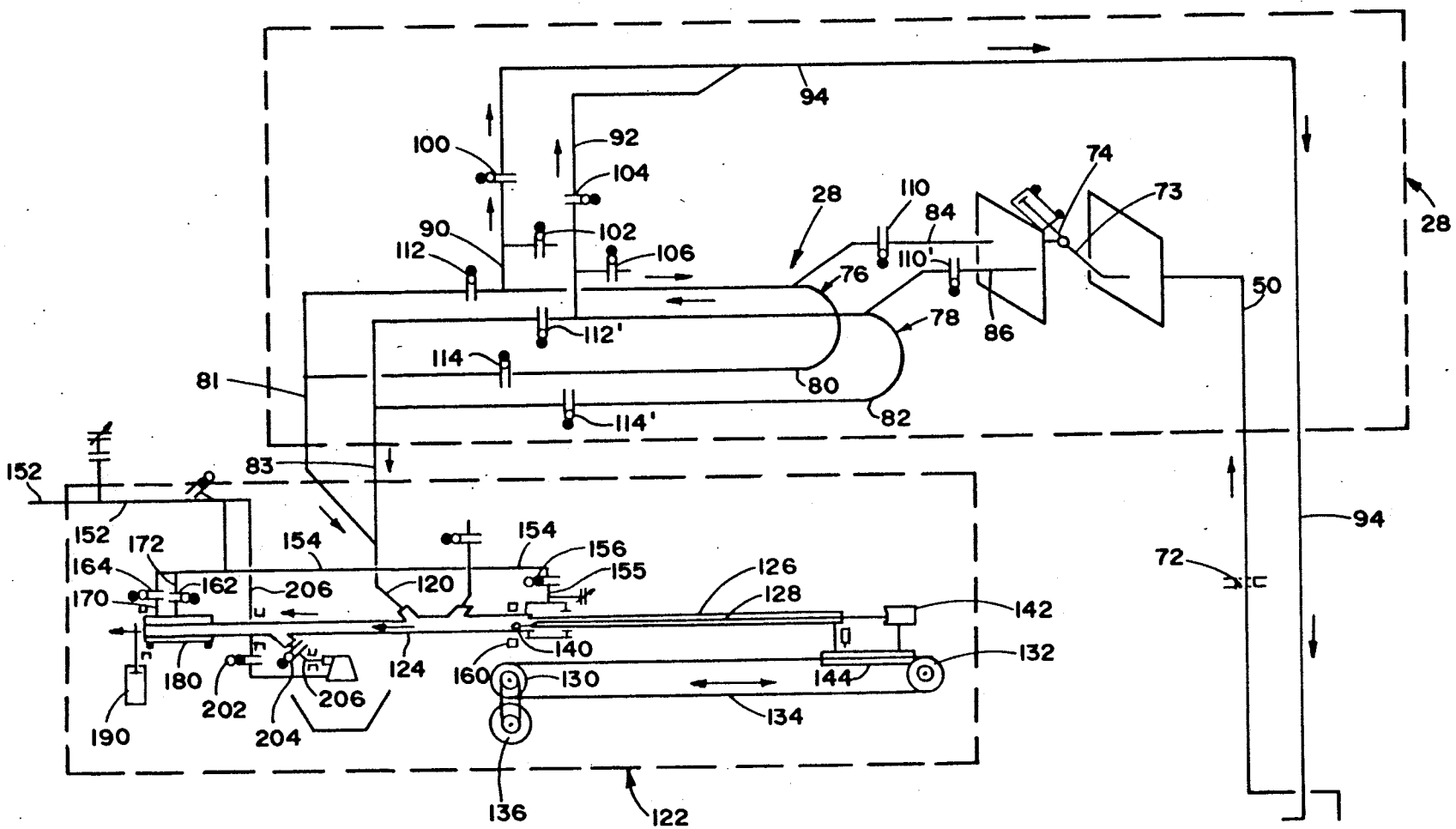
FIG. 3 is an enlarged, schematic elevational view of the magazine assembly and an opening assembly.
Figure 4:
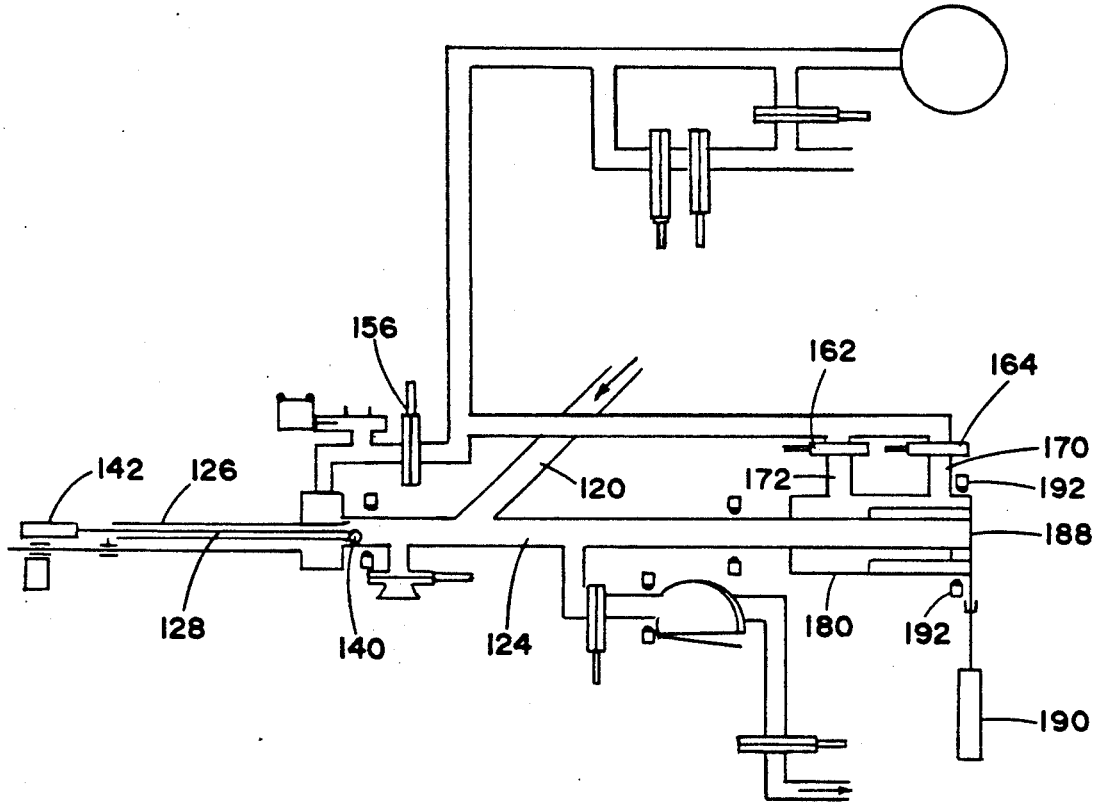
FIG. 4 is a schematic view of the opening assembly taken from the side opposite to that of FIG. 3.

Referring to FIG. 3, assuming that a blank H in conduit 50 is directed through displaceable conduit section 73, linear conduit section 84 and into the looped portion 80, the detector 72, upon sensing the passing blank, directs a signal to the micropressor MP which closes trap 70 and trap 100 to disrupt the vacuum flow, and to open trap 102. Traps 102 and 106 are exhausts for the air in front of the blanks travelling through the conduits so that the blank stops in the upper run of the loop portions 80 or 82 of the magazine assembly.

The traps 110, 112 and 114 of the magazine assembly are controlled by the micropressor in a particular sequence depending on whether the band portion or the toe portion of the blank enters the upper run of looped portion 80 first. If the toe portion E of a blank in the upper run of loop portion 80 is to the left and the band portion B to the right, FIG. 3, the blank exits to the left and travels through exit conduit 81 toe portion first. The end portion of the blank (toe or band) travelling first through conduit 50 is determined by the photocells 52, 58, as previously described and a signal to that effect is stored in the microprocessor. If the toe end is first into the magazine conduit assembly 76, the micropressor opens traps 112 and 110 and closes traps 114 and 102 such that a vacuum in exit conduit 81, from a source to be subsequently described, pulls the blank downwardly, toe end first towards the opening assembly 122.

If the band end enters the conduit 50 first this information, through the photocells 52, 58, is stored in the micropressor. The micropressor would then send signals to close traps 112 and 110 and open traps 114 and 102 to permit vacuum to pull the blank from the upper run of looped portion 80 to the right, FIG. 3, downwardly, and to the left in the lower run of looped portion 80 and into the exit conduit 81.

The conduit assembly 78 operates in a manner similar to assembly 76 and has traps 110', 112' and 114' which are selectively controlled by the micropressor in a manner similar to traps 112, 114.

The exit portions 81 and 83 communicating with the loop portions 80 and 82 converge into a single conduit 120. Conduit 120 directs blanks to the opening assembly 122.

Figures 5, 8:
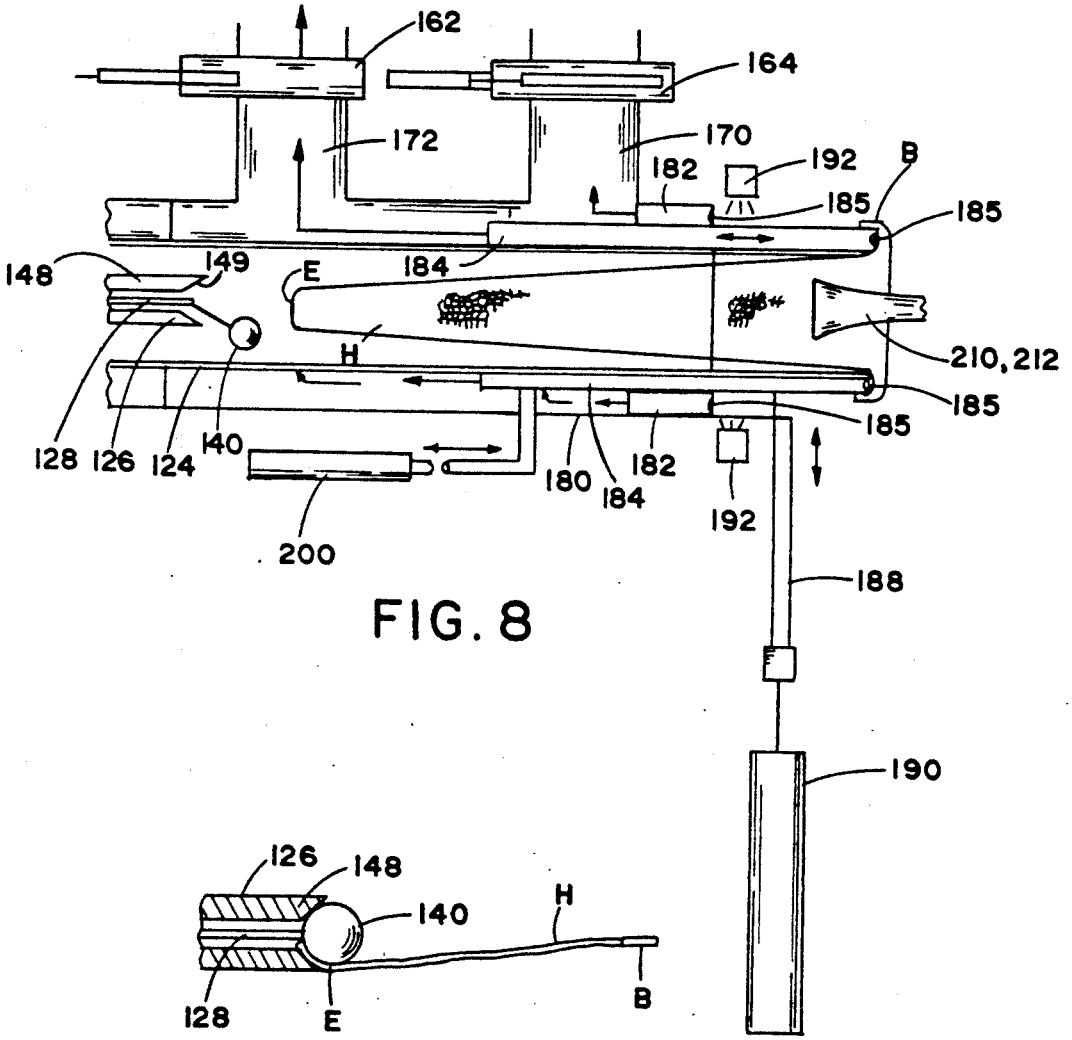
FIG. 5 is a fragmentary view, partly in section, of the opening assembly and illustrating the clamping of the toe portion of a hosiery blank thereto.
FIG. 6–8 are fragmentary views, partly in section, of the opening box of an opening assembly showing various positions of a hosiery blank therein.

The opening assembly 122, FIGS. 3–8, includes a fixed, elongated tubular section 124, an inner tubular section 126 mounted for displacement within the section 124 and an elongated rod-like section 128 positioned within the inner section 126 and mounted for displacement relative to the sections 124 and 126. The rod-like section 128 and the inner tubular section 126 are capable of being displaced together horizontally as a unit relative to outer tubular section 124 by means of pulleys 130, 132, belt 134 and reversible motor 136. The rod-like section 128 also is capable of being displaced relative to the inner tubular section 126. Coupled to one end of the rod-like section 128 is a ball element 140, FIGS. 3, 5, and coupled to the other end of the section 128 is a fluid cylinder. The cylinder 142 and the inner tubular section 126 are fixedly attached to a bracket or slide element 144 which, in turn, is coupled to the upper run of belt 134. Therefore, the motor 130 is capable of displacing the tubular section 126 and the rod section 128 together as a unit. In addition, cylinder 142 is capable of displacing the rod-like section 128 relative to the inner tubular section 126. One end portion 148 of the section 126 is angled, as shown by FIGS. 5, 8 such that upon actuation of the cylinder 142 and displacement of the rod section 128, the ball element 140 grips or wedges between it and the angled portion 149 the toe portion E of a blank.

Suction is created in the outer tubular section 124 by means of a vacuum motor 150, conduit 152, conduit 154, conduit 155, open trap 156 and outer tubular section 124. Traps 162 and 164 are closed at this time. As the toe portion E is pulled through conduit 120 and into tubular section 124, a photocell 160 detects the blank activating through the microprocessor the air cyclinder 142, which, through the rod section 128, pulls the ball element 140 towards the angled portion 149 of the inner tubular section 126, FIG. 5, thus clamping the toe end E of the blank against the angled portion 149. Trap 156 then is closed by the microprocessor to turn off the vacuum to the tubular section 124 and conduit 155, and traps 162, 164 are opened creating a vacuum through conduits 170, 172, conduit 152, and back to the vacuum motor 150. Trap 162, while in conduit 154, controls the flow through conduit 172 and trap 164 is in conduit 170.

Figure 7:
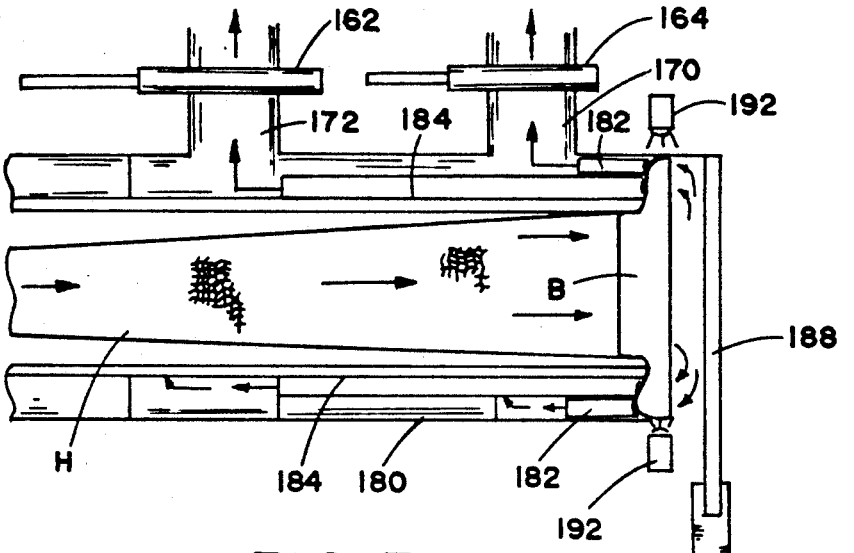
Figure 6:
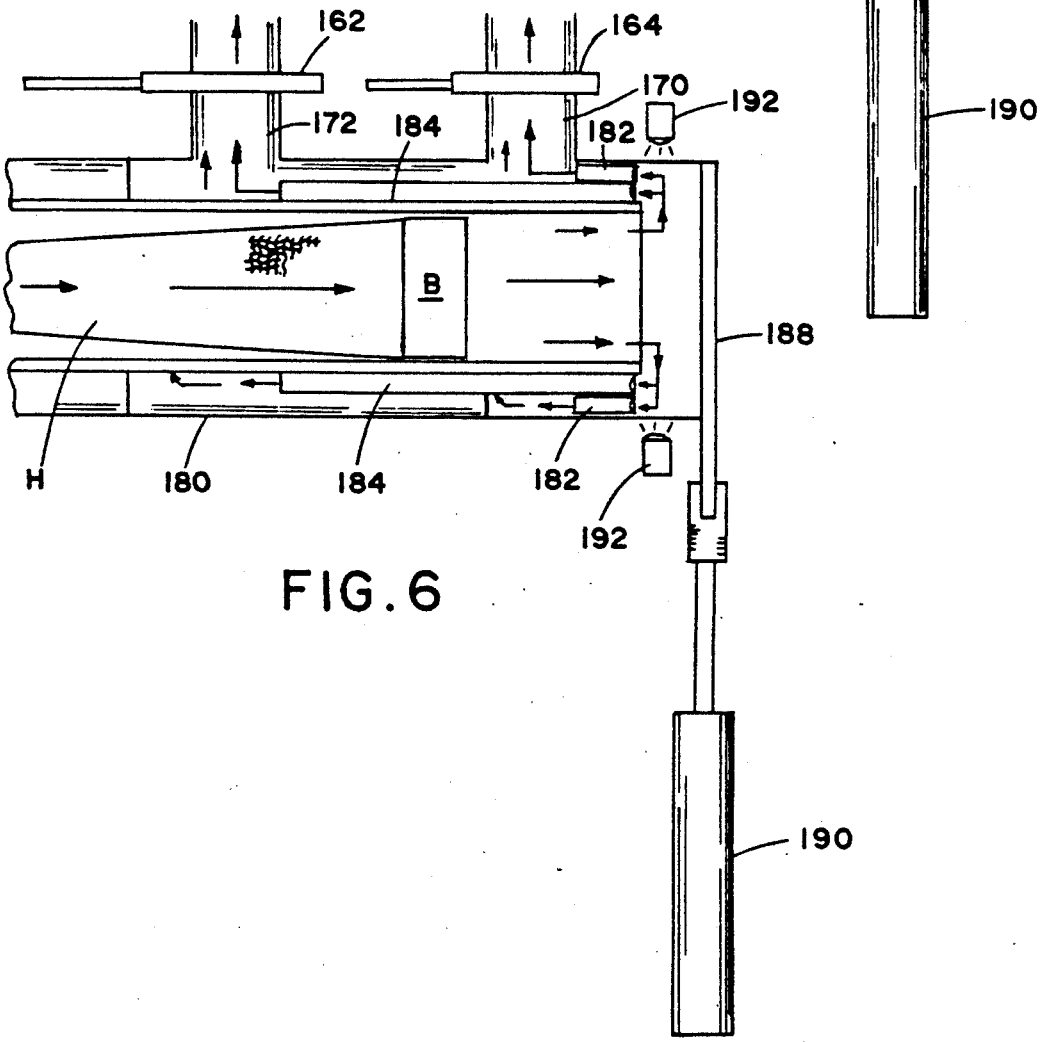

A opening box 180, FIGS. 3, 4 and 6–8, surrounds end portion of the tubular section 124 and includes a fixed grille 182 and a displaceable grille 184. Conduits 170 and 172 are connected to the box 180 as shown by FIGS. 6–8, such that a vacuum is drawn through tubular section 124, movable grille 184, and trap 162 and/or through tubular section 124, fixed grille 182, conduit 170 and trap 164. As shown by FIG. 6, the toe end E of the blank, not shown, is held by the ball element 140 and vacuum through the tubular section 124, openings 185, FIG. 8, in the ends of the grilles 182, 184, and conduits 170, 172 urges the band portion B of the blank towards an end of the box 180. Simultaneously with the closing of trap 156 and opening of traps 162, 164, the micropressor activates motor 136 to move the rod section 128 and inner loading section 126 to the left, FIG. 3, as a unit. This permits the blank to move to the right as shown by FIGS. 6 and 7. A displaceable plate 188 is located at the forward end of and normally closes the box 180. The plate 188 is mounted for displacement by a fluid cyclinder 190.

As the band end B of the blank passes the photocell 192 a signal is directed by means of the micropressor to the fluid cylinder 142 releasing the ball element and the toe end E of the blank. A microprocessor signal also is directed to the motor 136 which moves the rod section 128 and tubular section 126 back to the FIG. 3 position. A signal from the microprocessor is also directed to the fluid cylinder 190 which displaces the plate 188 from the FIG. 7 position to the FIG. 8 position, and to the air cylinder 200, FIG. 8, for initiating displacement of the moving grille 184 from the FIG. 7 position to the FIG. 8 position. As the moving grille 184 advances, trap 164 closes to remove vacuum from the fixed grille 182. Simultaneously with the closing of trap 164, traps 202 and 204 open and through the conduit 206 a vacuum is directed back through the box 180, to the left as shown in FIG. 8, and the tubular section 124 to keep the blank H stretch out straight. The cylinder 200 continues to advance the moving grille 184 to a position, FIG. 8, where the blank band portion B overlaps the loading fingers 210, 212 of a loading assembly 208. The fingers 210, 212 are initially in a collapsed condition as shown by FIGS. 8 and 10.

Figure 10:
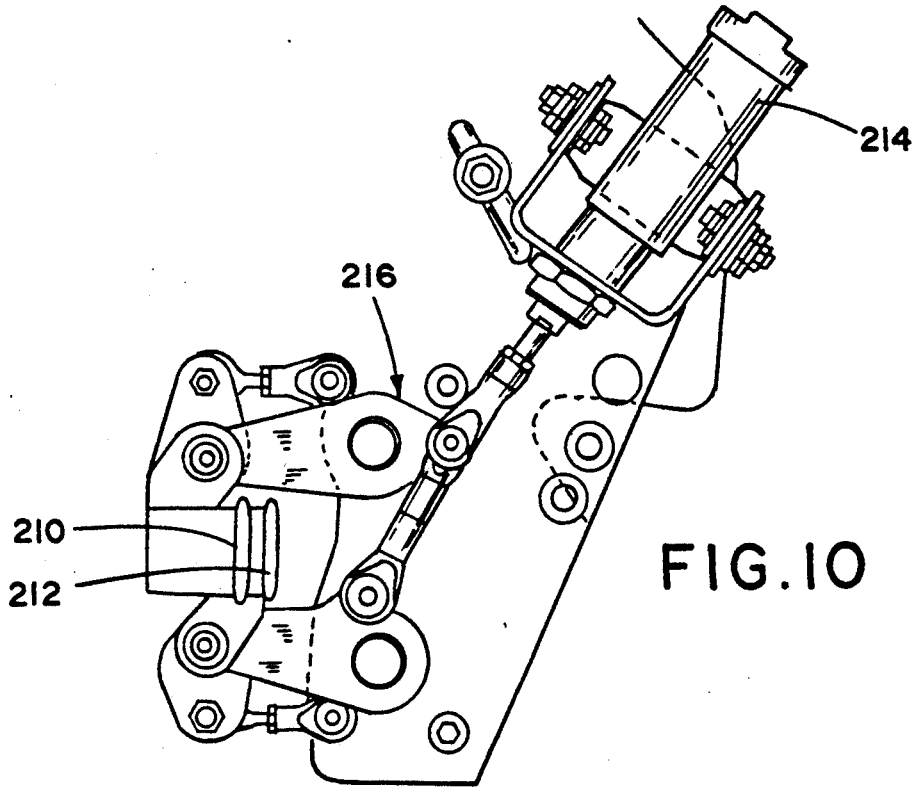
FIG. 10 is a side elevational view of hosiery blank loading fingers in a collapsed condition and the linkage mechanism for actuating the fingers.
Figure 11:
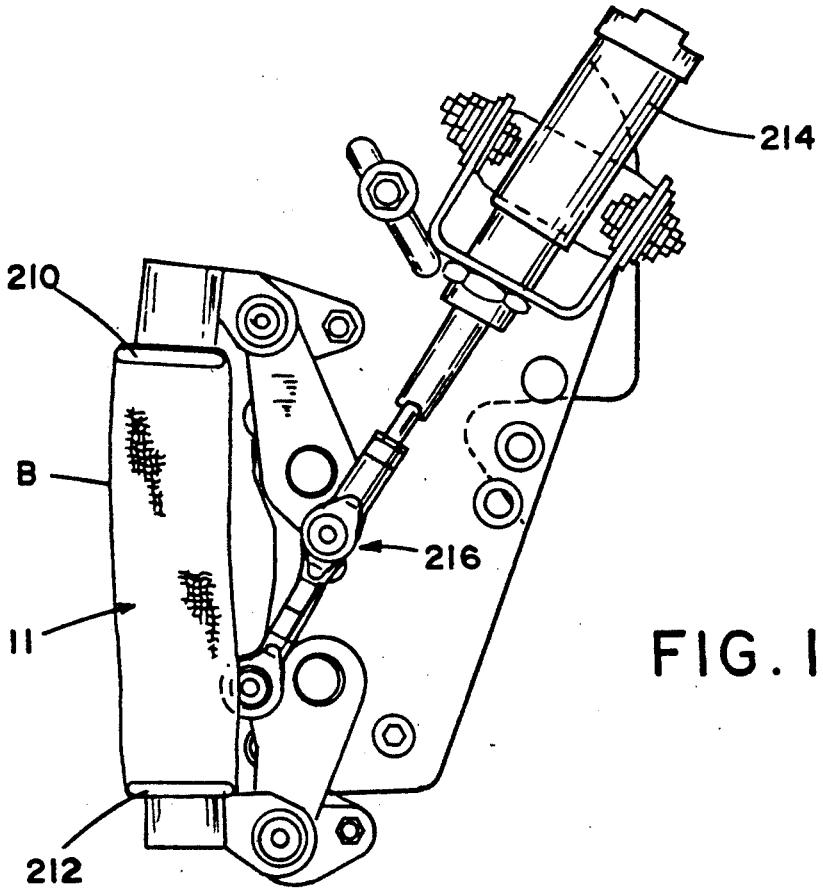
FIG. 11 illustrates the fingers and linkage mechanism in an expanded position with the welt or band end of a blank positioned on the fingers.

As shown by FIGS. 10 and 11, the opening assembly 208 includes a linkage 211 having the fingers 210, 212 mounted thereon, a fluid cylinder 214 for opening and closing the fingers through the linkage, a pair of rail members 220,222 which serve as guides for the displaceable linkage 216 and fingers 210, 212 as they are moved by the fluid cylinder 224. Upon actuation of the fluid cylinder 214 and linkage 216 the fingers are moved to the FIG. 11 position thus engaging and expanding to an opened condition the band end B of the blank. While the lowermost rail 222 is fixed, the upper rail 220 is pivotably mounted at one end 226 and the opposite end is capable of being displaced by a fluid cylinder 228. The linkage 216 is coupled to guides 217 which are slidably mounted on rails 220,222.

When a blank is being carried forward by the movable grille 184, the fingers 210, 211 are in a collapsed condition with the fingers and linkage 216 to the right, FIG. 12, on the guide rails 220, 222. Once the grille advances to the forwardmost position with the blank band over the fingers, the fingers are expanded by the fluid cylinder 214 to expand the band portion of the blank as shown by FIG. 11. The fluid cylinder 224 then is activated to displace the fingers 210,212 to the left, FIG. 12 and extract the blank from the loading box 180 and the movable grille 184. At the same time the movable grille is retracted to the FIG. 6 position.

Figure 13:
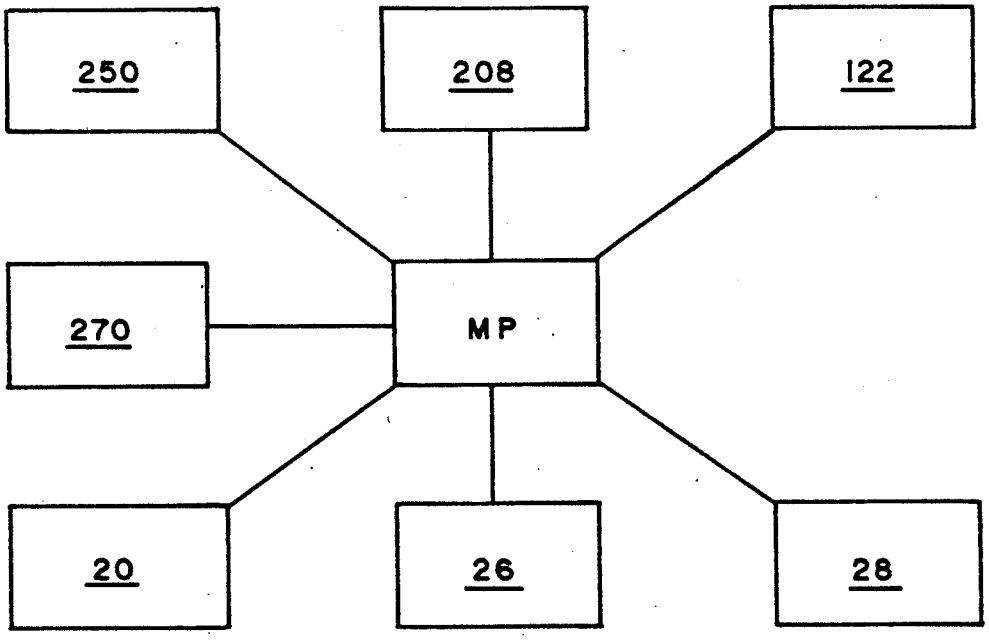
FIG. 13 is a schematic block diagram of the various assemblies and control means therefor.

The opening assembly 208 is positioned adjacent a toe closing mechanism 250, FIGS. 1 and 13, which preferably is of the type disclosed, for example, in U.S. Pat. Nos. 3,941,069; 4,383,490; and 4,550,868. The mechanism 250 includes a plurality of parallel, horizontally disposed, conventional transport tubes T mounted for displacement along an endless path to various work stations.

The transport tube T located at Station A, FIG. 1, has a vacuum drawn therethrough by vacuum motor 260. With the fingers 210,212 retracted to the leftmost position beyond the end of the tube T at station A, fluid cylinder 228 is activated to pivot the guide rail 220 such that the fingers 210,211 and blank held thereby are positioned at the end of the tube. The suction created by vacuum motor 260 draws the toe end E of the blank into the transport tube. Fluid cylinder 224 is reactivated and the fingers 210,212 are displaced to the right, FIG. 12, and the hosiery blank H is pulled band end first over the outer portion of the transport tube. At the farmost range of cylinder 224, the band is held by an interdependent hook system of transport tube T. When cyclinder, 224 moves backwardly, the band B slides from the fingers 210,212 and falls on the transport tube T. Then the fingers move back to the position where they can receive another blank from the opening box 180.

Wind-on wheels, not shown, as are conventional with toe closing machines, in combination with various blank position detectors, not shown, properly positions the blank on the transport tube T. The transport tube is then displaced to a sewing assembly 270 where conventional sewing instrumentalities 272 close the toe portion E of the blank. The sewing instrumentalities may be of the type disclosed in Pat. Nos. 4,609,419 or 4,383,490. Upon completion of the sewing operation the hosiery articles H are displaced by the transport tube to a station where the sewn article is removed therefrom and directed by conduit means 278 to a receptacle or other work station.

FIG. 13 illustrates schematically the control system or microprocessor for actuating the various motors, traps, fluid cylinders and control mechanisms of the various loading, magazine, conveying, pick-up and sewing assemblies. Such controls form no part of the invention and are conventional in nature.

While a preferred embodiment of the invention has been disclosed, it should be apparent that many mofidications therein may readily be made. Further, while the apparatus has been described as being particularly useful in handling and sewing hosiery blanks, it should be apparent that the same could be employed to handle other flexible articles and particularly where the concentration or volume of material forming one end portion of an article is greater than that of the other end portion.

What is claimed is:

1. The method of automatically conveying sequentially a series of tubular hosiery blanks, each having a toe end portion and a band end portion, to a toe closing machine having sewing instrumentalities and a plurality of elongated transport tubes comprising the steps of: retrieving a blank from a plurality of randomly oriented blanks in a supply reservoir; conveying the blank along a prescribed path to a predetermined location; sensing the blank as it travels along the prescribed path to determine whether the toe end portion or the band end portion is the leading end travelling along the prescribed path; selectively removing the blank from the predetermined location in a prescribed direction such that the toe portion is the leading end portion in the direction of travel and delivering the blank toe end portion first to an opening station; conveying the band end portion of the blank at the opening station to a prescribed position; expanding the band end portion of blank into an opened condition; positioning the blank upon a transport tube; conveying the blank to a sewing station; and sewing closed the blank toe end portion.

2. The method as recited in claim 1 wherein the band end portion is defined by a first volume of yarn and the toe end portion is defined by a second volume of yarn and the volume of yarn in the band end portion is greater than the volume of yarn in the toe end portion, and a particularly end portion is sensed by determining the volume of yarn in the particular end portion.

3. The method of conveying a series of flexible, elongated, tubular members, having first and second end portions, to a work station comprising the steps of: retrieving a tubular member from a plurality of randomly oriented tubular members located at a supply station; conveying the tubular member along a prescribed path to a receiving station; sensing a leading end portion of the tubular member as it travels along the prescribed path towards the receiving station to determine whether the sensed leading end portion is the first end portion or the second end portion; and discharging the member from the receiving station in a selected direction responsive to the sensed leading end portion of the tubular member first entering the receiving station.

4. The method of conveying a series of flexible, elongated, tubular members as recited in claim 3, and further including the steps of conveying the tubular member to an opening station, expanding one of said first and second end portions into an opened condition, and positioning the tubular member upon a support member.

5. The method of positioning a tubular hosiery blank, having a first band end and a second toe end, on a toe closing machine having sewing instrumentalities and a transport tube for receiving the blank and presenting the second toe end of the blank to the sewing instrumentalities comprising the steps of: gripping the second toe end of the blank; urging the first band end of the blank away from the second toe end; directing the blank along a prescribed path while opening the first band end; releasing the second toe end; expanding the first band end of the blank to a prescribed condition; conveying the blank to position the blank on the transport tube; and sewing closed the blank second toe end.

6. The method of automatically conveying a series of tubular hosiery blanks, each having a band end portion and a toe end portion to a toe closing machine having sewing instrumentalities and a plurality of elongated transport tubes for receiving the blanks and presenting the toe end portions to the sewing instrumentalities comprising the steps of: sequentially retrieving hosiery blanks from a supply of randomly oriented blanks and conveying the blanks to a predermined location, sequentially discharging the blanks from the predetermined location in a prescribed, oriented condition with the toe end portion exiting first from the predetermined location; selectively gripping and opening the band end portion; conveying the blank to a position on a transport tube; and sewing closed the toe and portion.

7. The method as recited in claim 6, and further including the steps of randomly conveying the toe end portion first or band end portion first to the predetermined location, and determining whether the toe end portion or the band end portion is the first portion to arrive at the predetermined location.

8. An apparatus for placing hosiery blanks, each having a toe end and a band end on transport tubes of a toe closing machine prior to sewing closed the toe ends including, means for sequentially randomly retrieving hosiery blanks from a supply source, means for conveying sequentially hosiery blanks to a magazine assembly, sensor means for determining whether the toe end or a band end of each blank is the leading end of the blank as it is directed by said conveyor means to said magazine assembly, control means for directing each hosiery blank toe end first from said magazine assembly, loading means for opening and expanding the band end of each hosiery blank, and means for positioning each hosiery blank on a transport tube of the toe closing machine.

9. Apparatus as recited in claim 8, wherein said means for retrieving hosiery blanks from the supply source includes a first pick-up means for transferring a single hosiery blank from a stack of randomly oriented blanks to a predetermined position, second pick-up means for receiving said single hosiery blank from said first pick-up means and transferring said single blank to said conveyor means.

10. Apparatus as recited in claim 9, wherein each of said first and second pick-up means includes an elongated tube, means for reciprocating said elongated tube along a prescribed path, means for selectively creating a vacuum in said elongated tube, means for selectively directing an air blast through said elongated tube, and means mounted on said elongated tube for sensing whether a hosiery blank is held by said vacuum created through said elongated tube.

11. Apparatus as recited in claim 8, said magazine assembly including at least one conduit defining a loop configuration, said control means directing each hosiery blank within said loop configuration therefrom in such a direction such that the toe end is the leading end in the direction of travel of the hosiery blank.

12. Apparatus as recited in claim 8, said loading means including a first loading assembly for selectively gripping the toe end of each hosiery blank and means for elongating the hosiery blank and opening the band end of the blank, and second loading means for expanding said band end of the blank to remove the blank from said first loading assembly and convey the blank to a transport tube.

13. Apparatus for transporting a hosiery blank having a toe end portion and a band end portion comprising, supply means having a plurality of randomly positioned hosiery blanks therein, conveyor means for randomly withdrawing the blank from said supply means and transporting the same to said conveyor means, said conveyor means including means for transporting said blank along a prescribed path to a predetermined location, means for sensing the hosiery blank to determine which of the band end or toe end portions is a leading end of said hosiery blank as it is transported by said conveyor means to said predetermined location, and means for transporting said hosiery blank, from said predetermined location to a work station in a direction such that the toe end portion is the leading end of the hosiery blank.

14. Apparatus as recited in claim 13, wherein means at said work station is provided for selectively gripping the toe end portion of the hosiery blank and urging the band end portion away from said toe end portion to elongate the blank, and means for opening the band end portion of the blank.

15. Apparatus as recited in claim 14 and further including means for engaging said band end portion of said blank to convey said blank from said work station to a transport tube of a toe closing machine.

16. Apparatus for handling a hosiery blank having a toe end portion and a band end portion in preparation for sewing closed the toe end portion by sewing instrumentalities of a toe closing machine comprising, means for gripping the toe end portion of said hosiery blank by urging said band end portion away from said toe end portion and for opening band end portion, means for releasing said gripping means, and means for engaging and expanding said band end portion and conveying the blank to the toe closing machine.

17. An apparatus for placing flexible elongated, tubular articles, each constructed of material defining a first volume at a first end portion and defining a greater volume at a second end portion, in a prescribed, oriented manner at a selected location comprising; supply means having a plurality of randomly positioned tubular articles therein, means for sequentially randomly retrieving the articles from said supply means, means for conveying sequentially the articles to a magazine assembly, means for determining which of said first and second end portions is a leading end of an article as it is directed by said conveyor means to said magazine assembly by determining the volume of the leading end of the article, and means for removing the articles from said magazine assembly to the selected location in predetermined directions such that the leading end portion is always a selected one end portion of said first and second end portions.

18. The method of conveying a series of flexible, elongated, tubular members, having first and second end portions to a work station comprising the steps of: retrieving a tubular member from a plurality of randomly oriented tubular members, conveying the tubular member along a prescribed path to a receiving station, sensing an orientation of the tubular member as it travels along said prescribed path to determine which end portion of said first and second end portions is the leading end portion as the tubular member travels along said prescribed path, discharging the tubular member from said receiving station in a predetermined direction responsive to the orientation of the tubular member as it traveled along said prescribed path.

19. Apparatus for conveying a series of flexible, elongated members each having a first end portion and a second end portion in a prescribed, oriented manner to a selected location comprising; supply means having a plurality of randomly positioned elongated members therein, means for sequentially randomly retrieving the members from said supply means and conveying the members to a prescribed location, means for sensing the orientation of said members as they are conveyed to said prescribed location to determine which end portion of said first and second end portions is a leading end of said members, and means for removing said members from said prescribed location to said selected location in predetermined directions such that the leading end portion of said members is always a selected end portion of said first and said second end portions.

20. Apparatus as recited in claim 10, and further including means for engaging said open end portions of said elongated tubular members for transferring said elongated tubular members to a work station.

21. Apparatus for automatically handling and orientating flexible, elongated tubular members having first and second end portions comprising; conveyor means for receiving randomly oriented flexible, elongated tubular members and sequentially directing said elongated tubular members to a first station, means for determining whether the first end portions or the second end portions of each of said elongated tubular members is a leading end portion as the elongated tubular members are directed to said first station, and means for discharging said elongated tubular members from said first station to a second station in a predetermined orientation, and means for opening one end portion of said first and second end portions of said elongated tubular members at said second station.

22. The method of conveying a flexible, elongated tubular blank having first and second end portions to a machine for closing the second end portion comprising the steps of; retrieving a blank from a plurality of randomly oriented blanks, conveying the blank to a receiving station, sensing a leading end portion of the blank as it is being conveyed to determine whether the sensed leading end portion is the first end portion or the second end portion, transporting the blank from the receiving station in a selected direction to an opening station such that said second end portion is the leading end portion entering the opening station, expanding the first end portion of the tubular blank into an opened condition, and conveying the tubular blank to a machine for subsequent closing of the tubular blank second end portion.

23. In apparatus for placing elongated, flexible, tubular hosiery articles, each having a band end portion and a toe end portion, on a transport tube, means for retrieving sequentially randomly oriented hosiery articles and transporting such articles individually to a work station in a predetermined orientation, means at said work station for expanding into an opened condition said band end portions of said hosiery articles, hosiery article receiving means including a transport tube operable to receive hosiery articles thereon, and means for maintaining said hosiery articles band end portions in an opened condition and conveying the hosiery articles from the work station to said transport tube.

24. An apparatus as recited in claim 23, wherein there are a plurality of transport tubes, means for closing said toe end portions of said hosiery articles, and means for sequentially conveying transporting tubes having hosiery articles thereon to said means for closing said toe end portions of said hosiery articles.

25. An apparatus as recited in claim 23, wherein said means at said work station for expanding into an opened condition said band end portions includes means for selectively gripping the hosiery articles toe end portions, and means for urging said band end portions of the hosiery articles away from said toe end portions.

26. The method of conveying sequentially a series of tubular hosiery blanks, each having a toe end portion and a band end portion comprising the steps of; retrieving a blank from a plurality of randomly oriented blanks, conveying the blank to an opening station such that the blank toe end portion is the leading end entering the opening station, gripping the toe end portion of the blank, urging the band end portion of the blank away from the toe end portion of the blank to elongate the blank, expanding open the band end portion of the blank, conveying the blank while retaining the band end portion of the blank in an open, expanded condition from the opening station, and closing the toe end portion of the blank.

* * * * *